US005951370A

United States Patent [19]

Cesna

[11] Patent Number: 5,951,370

[45] Date of Patent: Sep. 14, 1999

[54] METHOD AND APPARATUS FOR MONITORING AND CONTROLLING THE FLATNESS OF A POLISHING PAD

[75] Inventor: Joseph V. Cesna, Niles, Ill.

[73] Assignee: SpeedFam-IPEC Corp., Chandler, Ariz.

[21] Appl. No.: 08/944,937

[22] Filed: Oct. 2, 1997

[51] Int. Cl.[6] ..... B24B 53/00

[52] U.S. Cl. ..... 451/21; 451/56; 451/443; 451/6

[58] Field of Search ..... 451/6, 41, 288, 451/287, 443, 444, 56, 21

[56] References Cited

U.S. PATENT DOCUMENTS

| | | | |
|---|---|---|---|
| 4,693,012 | 9/1987 | Cesna . | |
| 5,456,627 | 10/1995 | Jackson et al. . | |
| 5,486,131 | 1/1996 | Cesna et al. . | |
| 5,618,447 | 4/1997 | Sandhu . | |
| 5,664,987 | 9/1997 | Renteln . | |
| 5,665,201 | 9/1997 | Sahota . | |
| 5,708,506 | 1/1998 | Birang . | |
| 5,736,427 | 4/1998 | Henderson | 438/14 |
| 5,801,066 | 9/1998 | Meikle | 438/14 |

FOREIGN PATENT DOCUMENTS 0 816 017 A1 1/1998 European Pat. Off. .

*Primary Examiner*—Robert A. Rose
*Attorney, Agent, or Firm*—Snell & Wilmer LLP

[57] ABSTRACT

A laser element is mounted above a polishing pad of a workpiece polishing machine to monitor and control flatness of the pad. Actual flatness of the pad is determined by a computer processor which receives thickness measurements from the laser element and compares the thickness at the inner diameter portion of the pad with the thickness at the outer diameter portion of the pad. If the flatness varies substantially from a target flatness, a conditioning device mounted on the machine is moved appropriately relative to the pad to conform its flatness to the target flatness.

25 Claims, 10 Drawing Sheets

METHOD AND APPARATUS FOR MONITORING AND CONTROLLING THE FLATNESS OF A POLISHING PAD

TECHNICAL FIELD

The present invention relates, generally, to machines for polishing or planarizing workpieces such as semiconductor wafers, and more particularly, to a method and apparatus for monitoring and controlling the flatness of polishing pads used for planarization of such workpieces.

BACKGROUND OF THE INVENTION

The production of integrated circuits begins with the creation of high-quality semiconductor wafers. During wafer fabrication, wafers undergo multiple masking, etching, and dielectric and conductor deposition processes. Because of the high-precision required in the production of integrated circuits, an extremely flat surface is needed on at least one side of the semiconductor wafer to ensure proper accuracy and performance of the microelectronic structures being created on the wafer surface. As the size of integrated circuits continues to decrease and the number of microstructures per integrated circuits continues to increase, the need for precise and extremely flat wafer surfaces is growing in importance. Accordingly, it is usually necessary to polish or planarize the surface of the wafer between each processing step in order to obtain the flattest surface possible.

Chemical mechanical planarization ("CMP") machines are often utilized for polishing and planarizing semiconductor wafers. Such machines are well known in the art and are described in, for example, Arai, et al., U.S. Pat. No. 4,805,348, issued February, 1989; Arai, et al., U.S. Pat. No. 5,099,614, issued March, 1992; Karlsrud et aL, U.S. Pat. No. 5,329,732, issued July, 1994; Karlsrud, U.S. Pat. No. 5,498,196, issued March, 1996; and Karlsrud et al., U.S. Pat. No. 5,498,199, issued March, 1996. These references are incorporated herein by reference.

CMP methods for polishing wafers generally involve attaching one side of a wafer to a flat surface of a wafer carrier or chuck, and pressing the opposite side of the wafer against an abrasive top surface of a polishing pad. The abrasive top surface of the pad incorporates an abrasive material such as cerium oxide, aluminum oxide, fumed/precipitated silica or another particulate abrasive, while the underlying pad is formed from a commercially available material such as blown polyurethane. A commercially available pad, such as the IC 1000, SUBA IV or GS series pads from Rodel Products Corporation of Scottsdale, Ariz., may be utilized. The hardness and density of the polishing pad is typically dependent upon the material to be polished.

During polishing, the workpiece (e.g., wafer) is pressed against the polishing pad surface while the pad rotates about its vertical axis. The wafer may also be rotated about its vertical axis and radially oscillated back and forth over the surface of the pad to augment the polishing process. Because polishing pads tend to wear unevenly, a conditioning device is often utilized to remove surface irregularities from the pad and to ensure accurate planarization and polishing of all workpieces. The conditioning device may take the form of a conditioning ring separately mounted on an operating arm which contacts the pad remotely from the wafer carrier (ex situ conditioning), or it may be a conditioning ring surrounding the wafer carrier which conditions the pad during wafer processing (in situ conditioning). In situ conditioning is described in detail in U.S. patent application Ser. No. 08/683,571, filed Jul. 15, 1996 and entitled "Method and Apparatus For Conditioning Polishing Pads Using Brazed Diamond Technology, which is incorporated herein by reference.

Although known conditioning devices typically remove most localized pad surface irregularities, pad wear still causes fluctuations and unpredictability in the overall pad flatness or profile. As illustrated in FIG. 1, pad flatness 156 is generally measured by calculating the difference between the pad's outer diameter thickness or profile 146 and the pad's inner diameter thickness or profile 144. When pad outer diameter thickness 146 is less than pad inner diameter thickness 144, the pad assumes a convex flatness profile. Conversely, when outer diameter thickness 146 is greater than inner diameter thickness 144, the pad assumes a concave flatness profile.

For optimum polishing effectiveness, the pad flatness profile should mirror the shape of the wafer surface being polished. A wafer having a convex flatness profile, for example, should be polished by a pad having a mating concave profile. Hence, rather than having a completely flat profile, the pad must usually possess some degree of concavity or convexity. Uneven polishing can still result when the polishing pad assumes too much of a convex or concave profile. Over polishing in the peripheral regions of the wafer, often referred to as "edge-fast" polishing, may occur when the profile of the pad is overly concave. Conversely, over polishing of the center region of the wafer, referred to as "center-fast" polishing, may occur when the pad profile is overly convex. To minimize such uneven polishing, continuous monitoring and maintenance of a proper pad flatness profile is necessary.

One known method for monitoring pad flatness is to measure material removal rates from different portions of the wafers after polishing. These measurements indicate whether edge-fast or center-fast polishing has occurred and, in turn, indicate whether the pad became overly concave or overly convex during polishing. This method, however, is not practical for large-scale wafer processing operations.

Another known method for monitoring pad flatness is through the use of mechanical flatness gauges, such as "Accu-flat" gauges manufactured by SpeedFam Corporation of Des Plaines, Ill. (see also Cesna, U.S. Pat. No. 4,693,012). Such gauges measure pad thickness at the pad's inner and outer diameters. The difference between the inner and outer diameter measurements indicates the convex or concave nature of the pad's profile.

A typical flatness gauge 400 is illustrated in FIG. 2. To measure inner diameter thickness, the base of gauge 400 is placed on top of wet polishing pad 126 while its indicator tip 127 is placed in contact with the exposed metal surface of polishing wheel 128 underneath the pad. To measure outer diameter thickness, a wedge 402 must usually be cut in the outer edge of pad 126 to allow indicator tip 127 to contact the metal surface below.

Placing gauge 400 on top of pad 126 in this manner poses a number of problems. For softer pads, such as the commercially available IC-1000 pads, the base of the gauge tends to sink into the pad, preventing accurate measurement of the profile. Moreover, the gauge may introduce contaminants onto the pad or scratch the pad's surface. Finally, flatness gauges typically cannot be used for in situ monitoring and maintenance of pad flatness, and are too time consuming for use during ex situ conditioning.

SUMMARY OF THE INVENTION

The present invention provides a method and apparatus for monitoring and controlling pad flatness which overcomes the shortcomings of the prior art described above.

In accordance with one aspect of the invention, a flatness monitoring and control apparatus comprises a laser element which periodically measures the thickness of the polishing pad at its inner and outer diameters.

In accordance with another aspect of the present invention, the laser element comprises first and second lasers which transmit measurements to a flatness controller having input means for receiving the measurements, a memory for storing the measurements and a processor for processing the measurements. The processor calculates pad flatness by subtracting the thickness of the pad at its outer diameter from the thickness at its inner diameter, or vice versa.

In accordance with a further aspect of the invention, the flatness controller also comprises output means for outputting control signals to the wafer polishing machine controller. The machine controller, in response to the control signals received from the flatness controller, moves a flattening device in a manner which wears the upper surface of the pad to a target flatness. In response to the control signals, the machine controller may also alter certain parameters affecting pad flatness such as processing time, rotation speeds and down force on the wafer.

BRIEF DESCRIPTION OF THE DRAWING FIGURES

The present invention will hereinafter be described in conjunction with the appended drawing figures, wherein like numerals denote like elements, and:

DETAILED DESCRIPTION OF PREFERRED EMBODIMENTS OF THE INVENTION

The subject invention relates generally to an apparatus and method for monitoring and controlling the flatness of a workpiece polishing pad. The particular embodiments discussed herein relate to pads which are used to polish semiconductor wafers. It should be appreciated, however, that the scope of the invention is not limited to this particular application and embraces any workpiece polishing apparatus for which flatness monitoring and control is needed.

Figure 3:
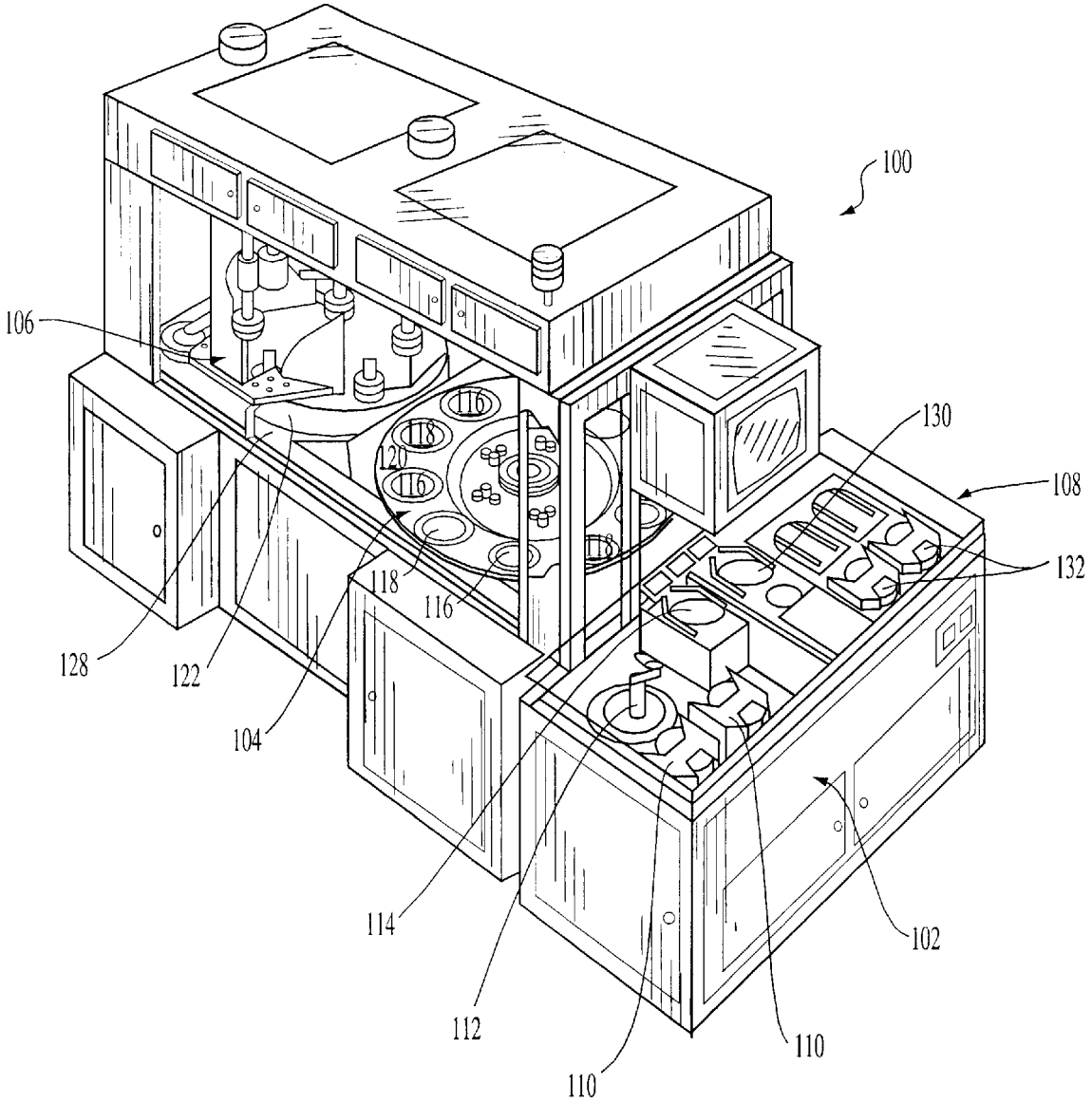
FIG. 3 is a perspective view of a typical semiconductor wafer polishing and planarization machine.
Figure 4:
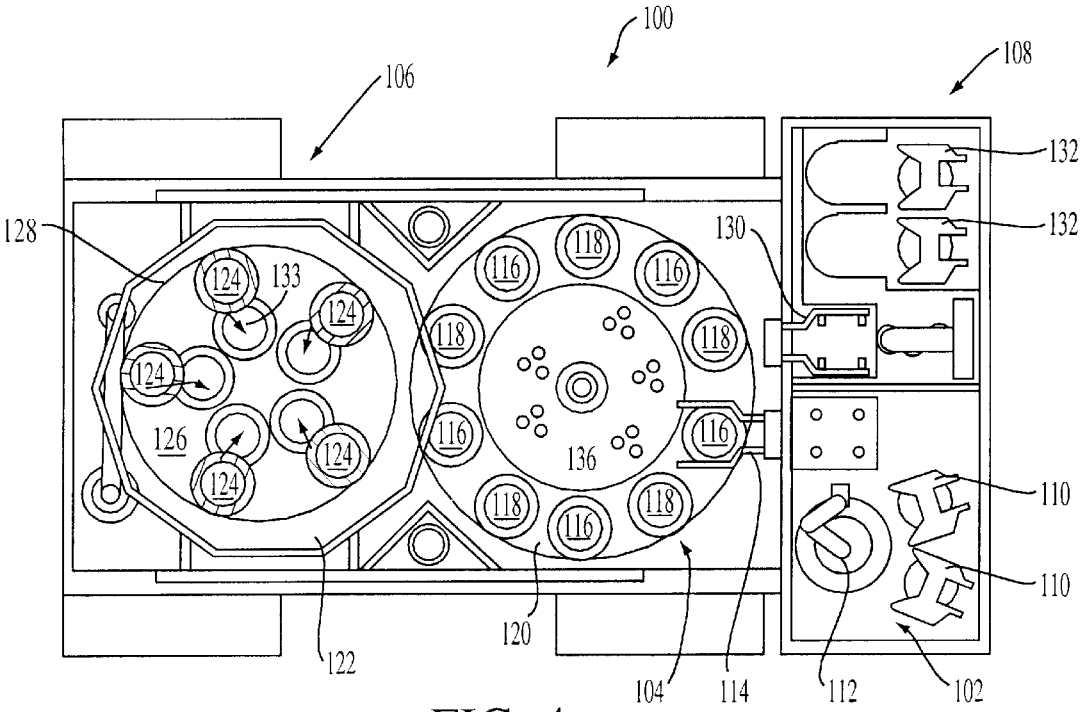
FIG. 4 is a plan view of the machine of FIG. 3 illustrating the polishing process.
Figure 5:
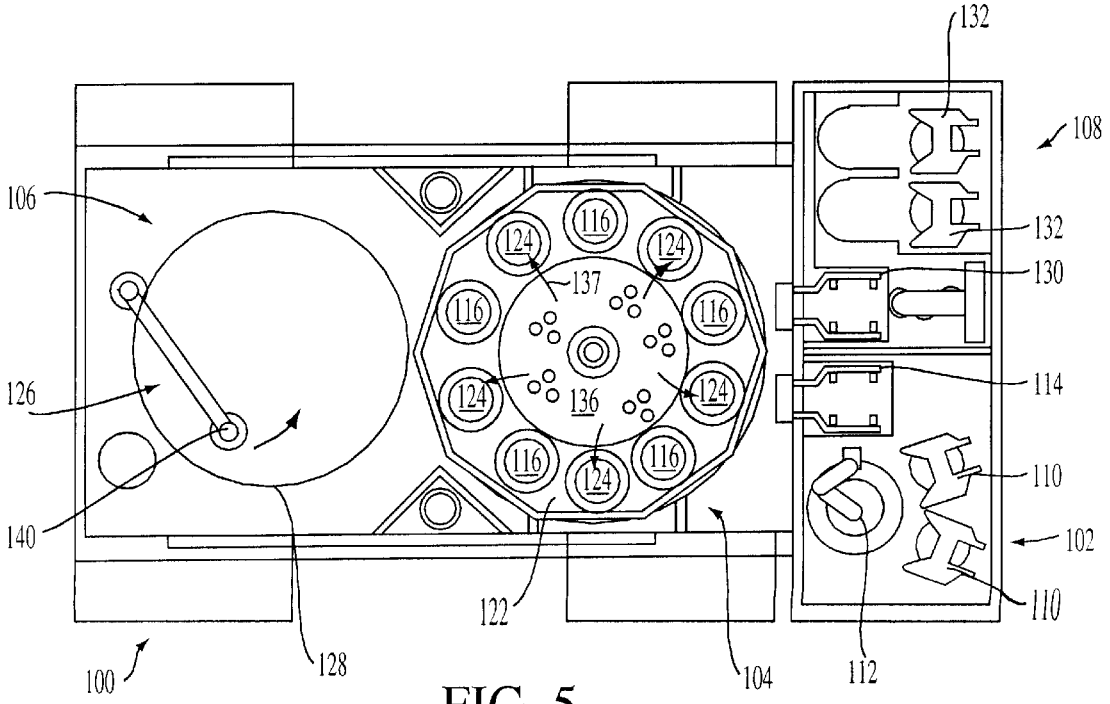
FIG. 5 is a plan view of the machine of FIG. 3 illustrating ex situ conditioning of a polishing pad.

A CMP machine 100 for polishing and planarizing wafers is illustrated in FIGS. 3–5. Machine 100 accepts wafers from a previous processing step, polishes and rinses the wafers, and reloads the wafers back into wafer cassettes for subsequent processing. It includes a load station 102, a wafer transition station 104, a polishing station 106, and a wafer rinse and load station 108.

Cassettes 110, each holding a plurality of wafers, are loaded into machine 100 at load station 102. Robotic wafer carrier arm 112 removes wafers from cassettes 110 and places them, one at a time, on first wafer transfer arm 114. Wafer transfer arm 114 transfers the wafers into pick-up stations 116 which reside on rotatable index table 120 within transition section 104. Table 120 also includes a plurality of drop-off stations 118 which alternate with pick-up stations 116. After arm 114 deposits a wafer onto a pick-up station 116, table 120 rotates to align the next station 116 with arm 114. Arm 114 then retrieves the next wafer from cassette 110 and places it on the aligned pick-up station. This process continues until each station 116 is occupied by a wafer. Index table 120 preferably includes five pick-up stations 116 and five drop-off stations 118.

Next, wafer carrier apparatus 122, comprising individual wafer carrier elements 124, is aligned over table 120 such that carrier elements 124 are positioned directly above pick-up stations 116. Apparatus 122 then lowers carrier elements 124 to retrieve the wafers from stations 116. Vacuum pressure is typically utilized to lift the wafers out of stations 116. Apparatus 122 then moves laterally into polishing station 106. Once apparatus 122 has moved into polishing station 106, carrier elements 124 are lowered to press the wafers held therein against rotating polishing pad 126, which is rotatably mounted on lap wheel 128. Carrier elements 124 simultaneously spin the wafers about their vertical axes and radially oscillate across pad 126 in the direction of arrow 133. In this manner, the wafer surfaces are polished and/or planarized.

After an appropriate period of polishing, carrier elements 124 are lifted from pad 126, and apparatus 122 returns to transition station 104. In station 104, elements 124 may be lowered to press the wafers against secondary polishing pad 136, which is located in the center of index table 120, and radially oscillated in the direction of arrow 137 to further polish the wafers (see FIG. 5). When polishing is complete, apparatus 122 lowers elements 124 to deposit the polished wafers into drop-off stations 118. Second transfer arm 130 then lifts the wafers out of stations 118 and transfers them into rinse and load station 108. Transfer arm 130 holds the wafers while they are rinsed and, after a thorough rinsing, transfers the wafers into cassettes 132. Cassettes 132 are then transported to subsequent stations for further processing or packaging.

Figure 1:
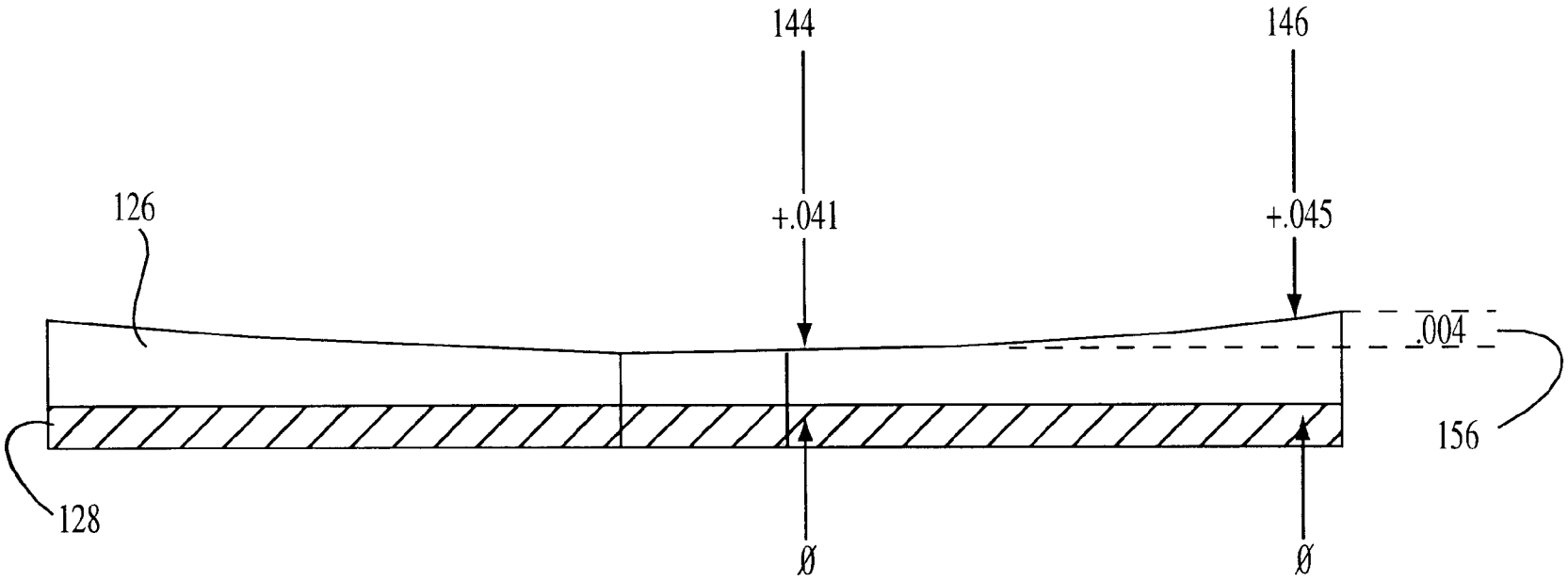
FIG. 1 is a sectional view of a typical polishing pad.
Figure 2:
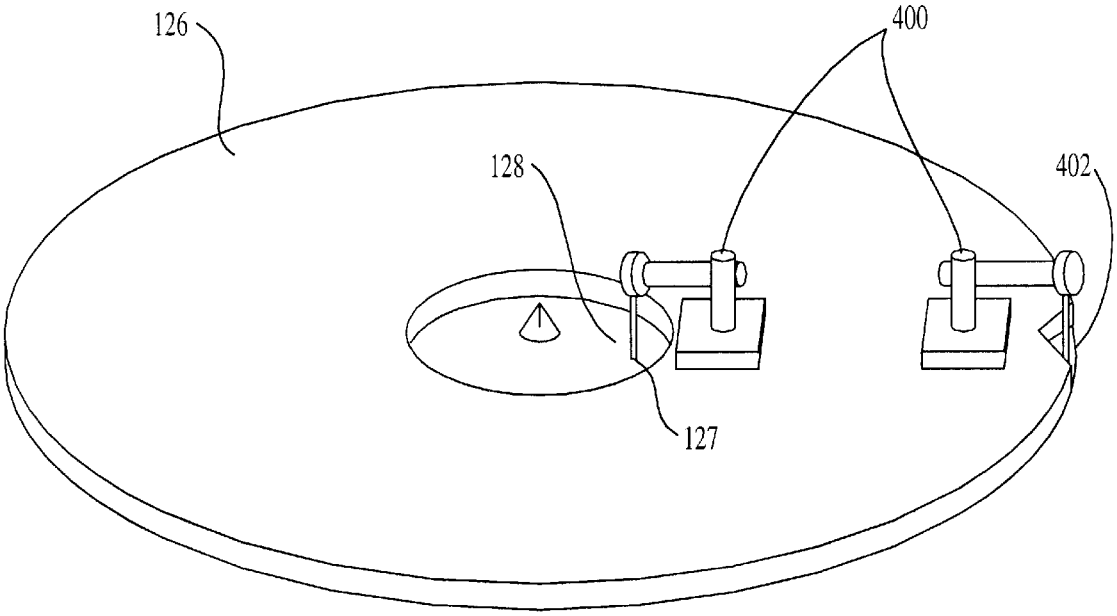
FIG. 2 PRIOR ART
FIG. 2 is a perspective view of a polishing pad with flatness gauges mounted thereon.

As described above, pad flatness is typically measured by subtracting the thickness of the pad at its inner diameter from the thickness at its outer diameter (see FIG. 1). A positive result indicates that the pad has a concave shape, while a negative result indicates that the pad has a convex shape. For semiconductor wafer polishing applications, pad flatness should preferably be maintained in a range from about +0.0005" (convex) to about −0.004" (concave), and most preferably at about −0.002" (concave). The optimum flatness range will, of course, vary depending on the particular application and wafer profile.

The polishing process, by its nature, wears pad 126 (and secondary pad 136, if utilized) and therefore alters the flatness of pad 126. Even if the pad initially has a flatness in the optimum range, as polishing proceeds and as batches of wafers cycle through, the pad flatness will change. Eventually, the flatness will deviate from its optimum range and uneven polishing will occur. If the flatness profile becomes overly concave, for example, edge-fast polishing will occur; whereas if the flatness profile becomes too convex, center-fast polishing will occur. Accordingly, it is extremely important to monitor and control the flatness of the polishing pad throughout the polishing process to avoid uneven polishing and to ensure that wafers are polished in an optimal or nearly optimal manner.

Figure 6:
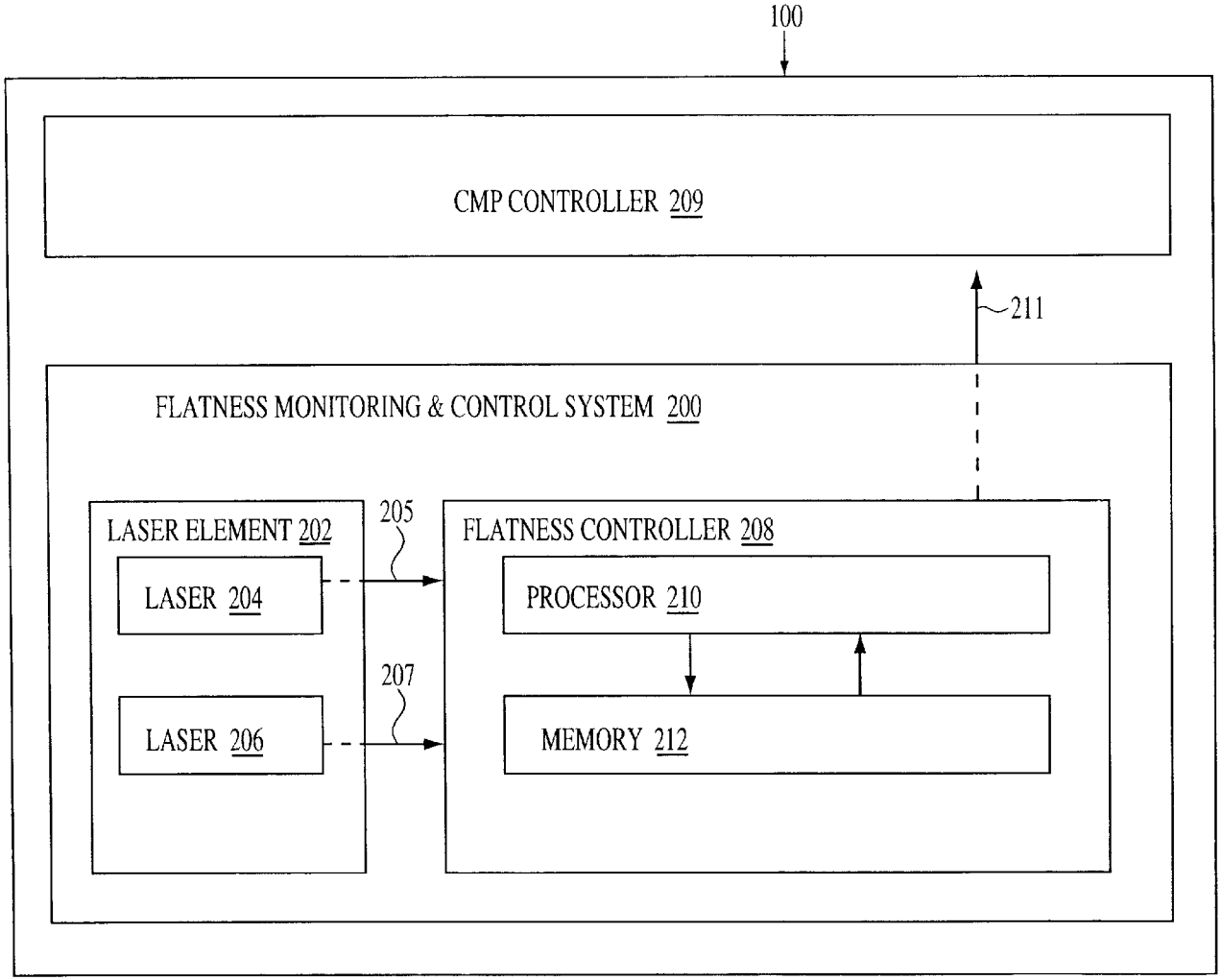
FIG. 6 is a flowchart illustrating operation of a pad flatness/profile measuring system.

A pad flatness monitoring and control system 200 (flatness system) according to the present invention is depicted generally in FIG. 6. Flatness system 200 preferably resides on or within CMP machine 100 and comprises laser element 202 and flatness controller 208. Controller 208 is preferably a computer controller having input means for receiving data signals 205 and 207, a memory 212 for storing data, a processor 210 for processing the data and output means for outputting control signals 211 based on the processed data. Appropriate computer controllers for manipulating data in this manner are well known to those of ordinary skill in the art. Controller 208 should be configured to operate in real time and to perform designated sets of tasks repeatedly and at a constant rate.

Laser element 202 includes lasers 204 and 206 which are configured to measure their respective distances from a reference target and to output digital signals 205 and 207, respectively, which are indicative of those measurements. Signals 205 and 207 are transmitted to controller 208 and stored in memory 212. Processor 210 calculates pad flatness based on signals 205 and 207 received from laser element 202 and generates an appropriate flatness control signal 211 which is transmitted to CMP machine controller 209. Laser element 202 and controllers 208 and 209 are electrically connected for communication in any known fashion, such as through hard wiring, or through RF or infrared communication links.

Figure 7:
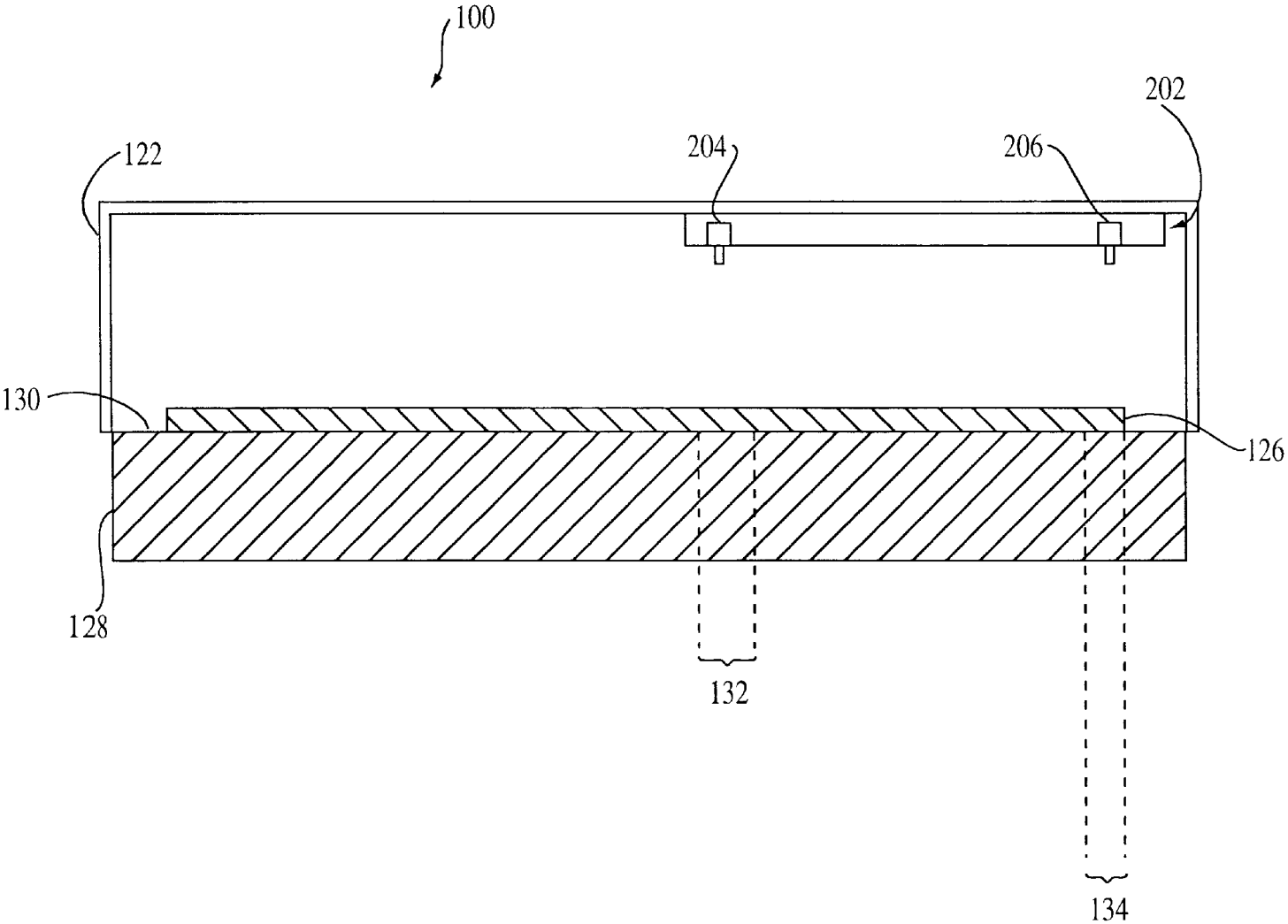
FIG. 7 is a sectional view of a portion of the machine of FIG. 3 with a laser element according to the present invention mounted thereon.

As shown in FIG. 7, lasers 204 and 206 are mounted on CMP machine 100 above polishing pad 126. The lasers are preferably mounted on overhead carrier apparatus 122 but, if appropriate, could be mounted on other structural members of machine 100. Laser 204 is mounted above inner diameter portion 132 of pad 126, and laser 206 is mounted above outer diameter portion 134 of pad 126. The spacing between the lasers, accordingly, is approximately equal to the spacing between the inner and outer diameter portions of the pad. Laser element 202 is preferably configured such that this spacing is adjustable for calibration purposes. Lasers 204 and 206 are also approximately equidistant from top surface 130 of lap wheel 128. Preferably, this distance is also adjustable. Mounted in this manner, laser 204 outputs signal 205 to controller 208 indicative of its distance from pad inner diameter 132, and laser 206 outputs signal 207 to controller 208 indicative of its distance from pad outer diameter 134.

As mentioned herein, several devices are known in the art for conditioning the surface of a polishing pad. The present invention manipulates the movement of these devices to control pad flatness. While the structure and operation of the two most commonly-used conditioning devices, ex-situ and in-situ conditioners, is described below, it should be appreciated that the present invention could be used in conjunction with any conditioning or pad-contacting device to control pad flatness.

Figure 8:
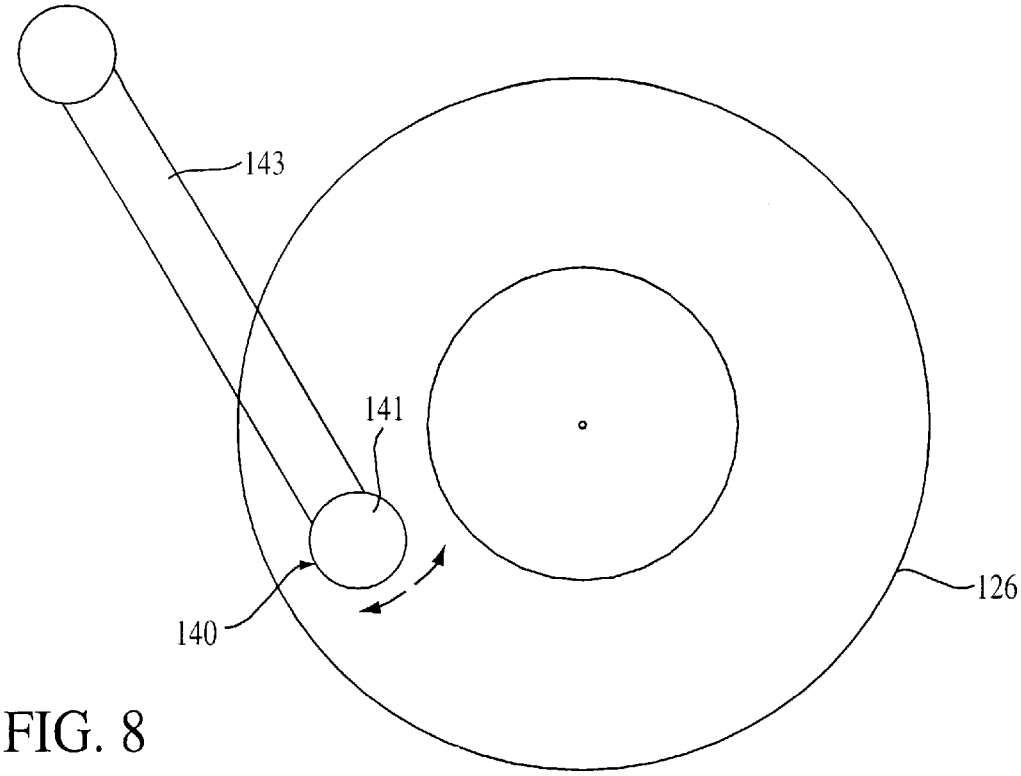
FIG. 8 is a plan view of a typical ex situ conditioning device and polishing pad configuration.

Ex-situ conditioning generally occurs between polishing steps. After a set of wafers has been polished and moved away from pad 126, a separate conditioning device 140 is pressed against pad 126 to condition the pad (see FIG. 5). Conditioning device 140, illustrated in detail in FIG. 8, comprises a circular ring 141 made of a rigid material that is provided with a downwardly depending peripheral flange (not shown) which contacts and conditions pad 126. The flange is typically embedded with abrasive materials, such as diamond particles, CBN particles, or the like.

Figure 9:
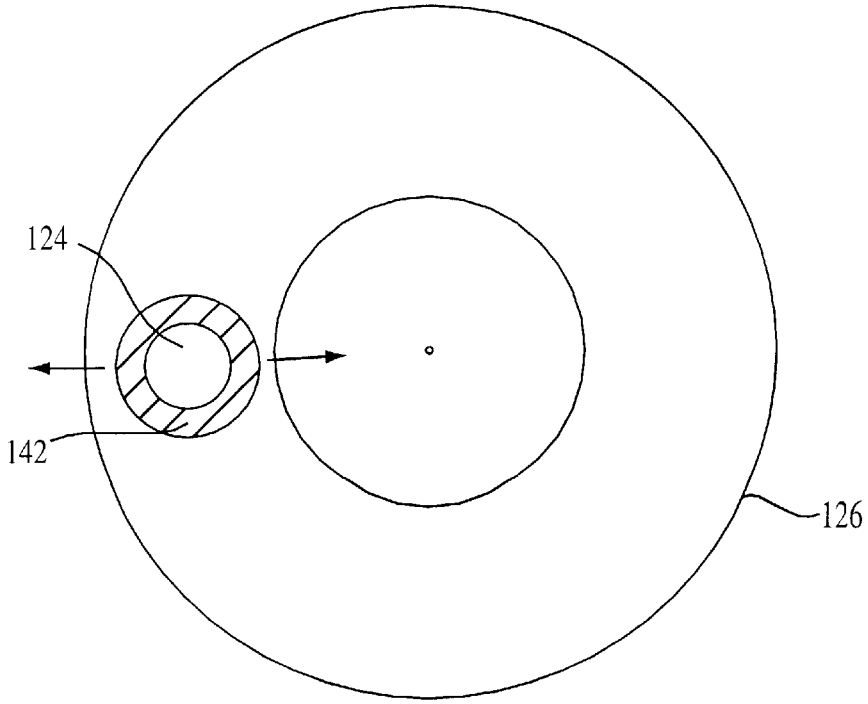
FIG. 9 is a plan view of a typical in situ conditioning device and polishing pad configuration.

In-situ conditioning generally occurs at the same time that wafers are being polished. As illustrated in FIG. 9, an in-situ conditioning element 142 surrounds each individual carrier element 124. As carrier elements 124 rotate and press the wafers against pad 126, conditioning elements 142 are also rotated and pressed against pad 126 and thus condition pad 126 while the wafers are being polished. As with ex-situ conditioning device 140, in-situ conditioning elements 142 preferably include a downwardly depending peripheral flange having abrasive particles which contact the pad surface.

During both ex-situ and in-situ conditioning, abrasive surfaces of the conditioning devices are pressed against the polishing pad to smooth out localized surface irregularities. The present invention recognizes that these conditioning devices may also be operated in a controlled manner to, in addition to eliminating local irregularities from the pad surface, wear the pad surface to a target flatness profile. It should be noted that while conditioning devices are preferred to control pad flatness, any apparatus contacting the polishing pad could potentially be controlled to affect pad flatness. Carrier elements 124 themselves, for example, could be moved in an appropriate manner during polishing to conform the pad surface to a target flatness profile.

Figure 10:
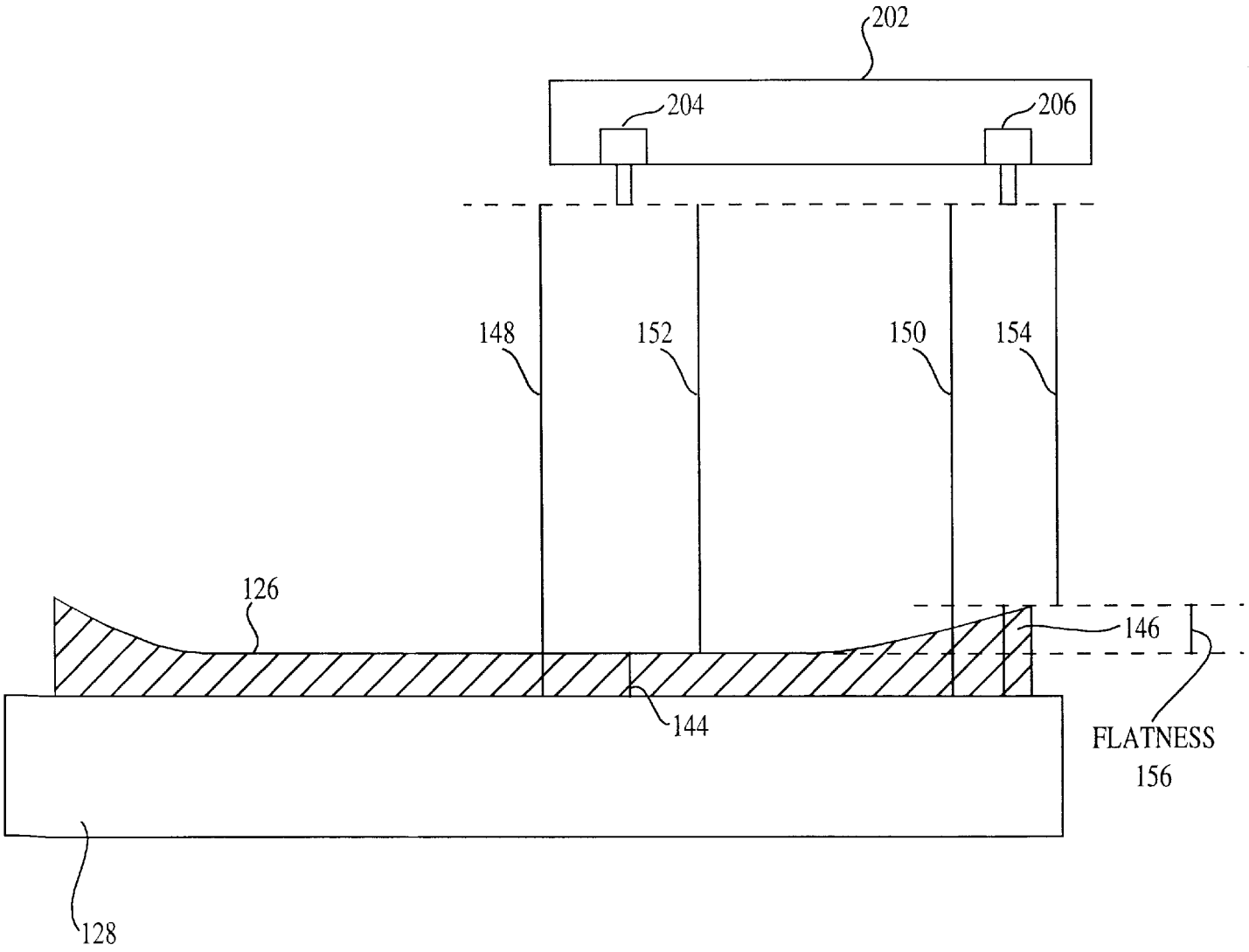
FIG. 10 is a side view of an apparatus for monitoring and controlling pad flatness according to the present invention.
Figure 11:
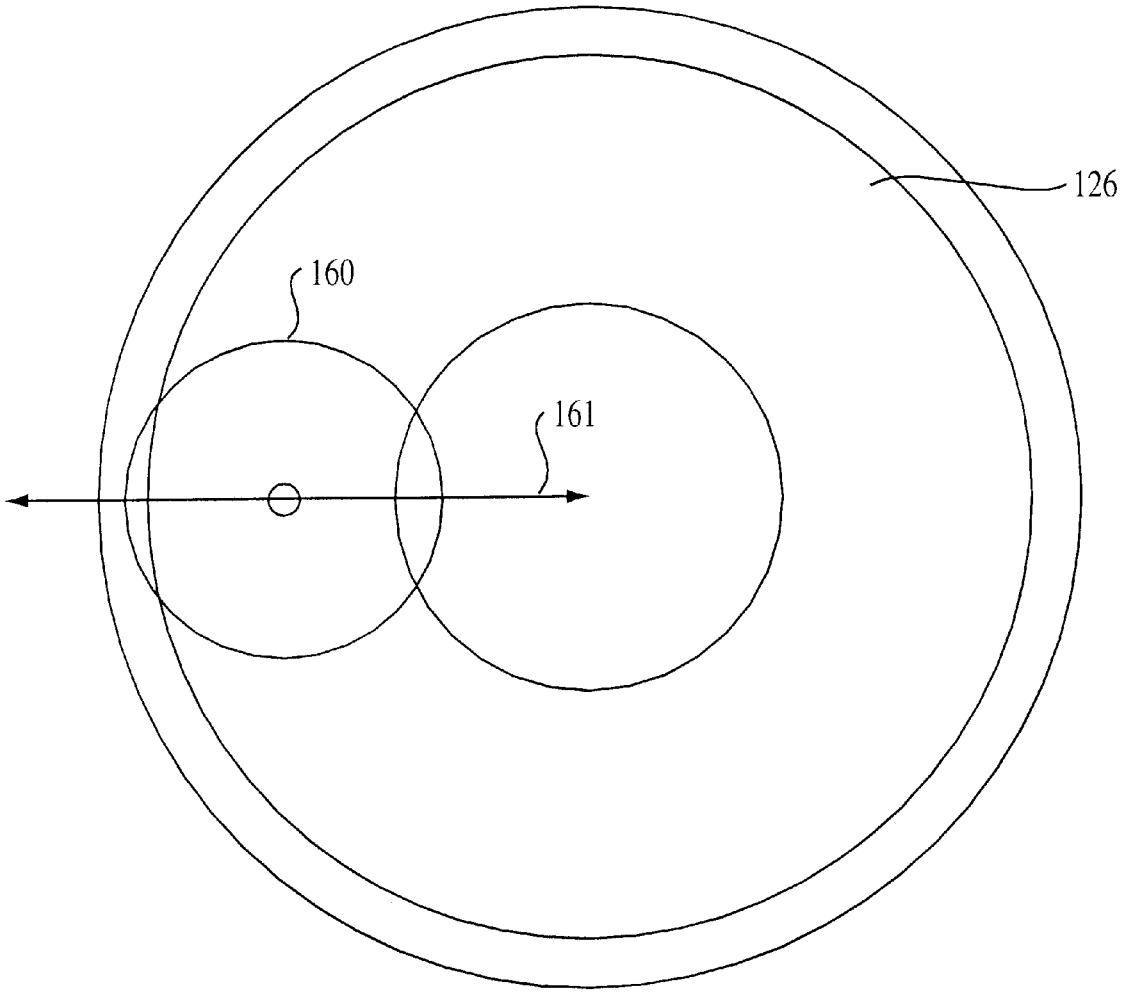
FIG. 11 is a plan view illustrating placement and movement ofthe apparatus of FIG. 10.
Figure 12:
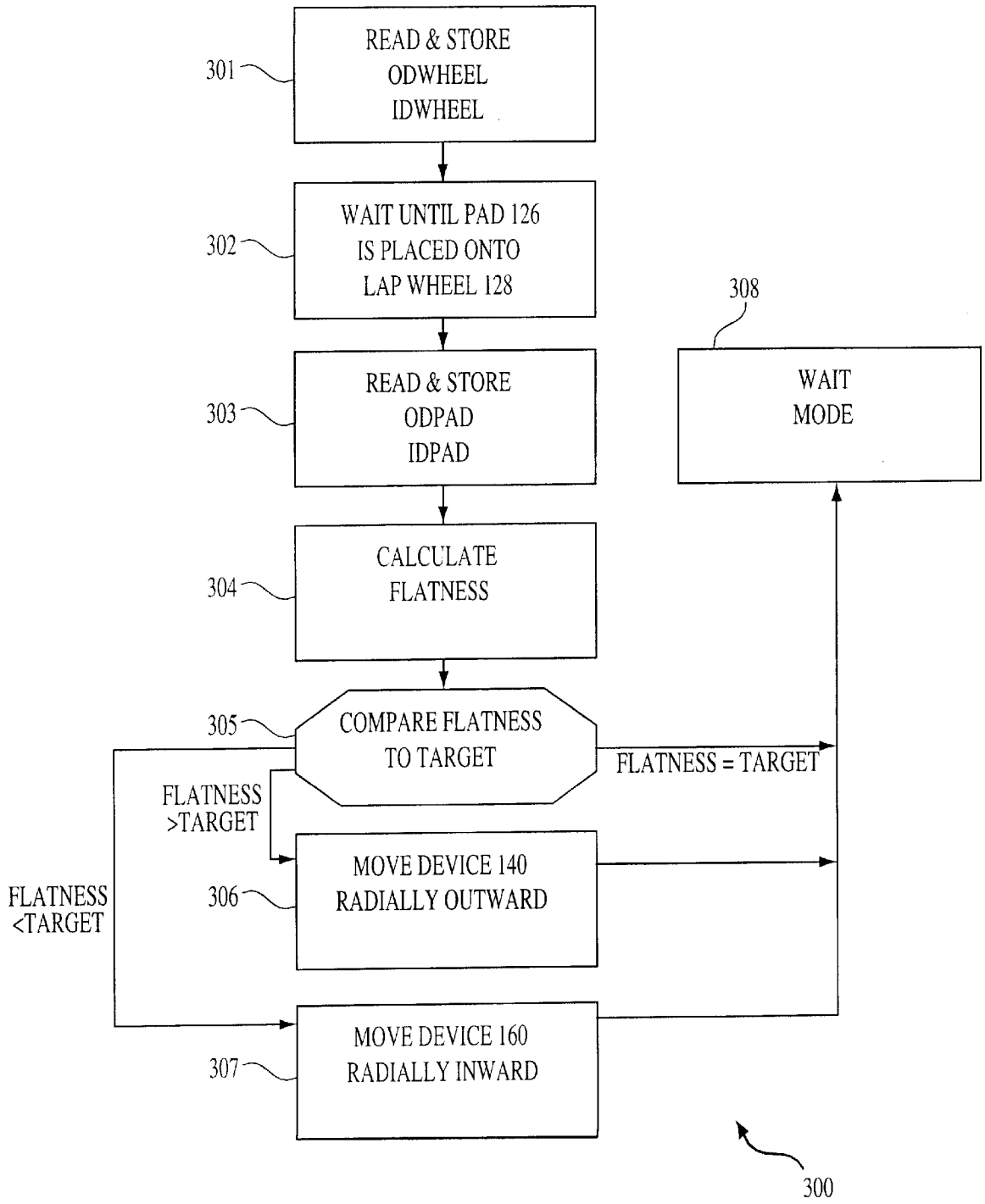
FIG. 12 is a flowchart illustrating operation of the flatness monitoring and control system of the present invention.

The function and operation of flatness control system 200 is illustrated in greater detail in FIGS. 10–12. Flatness system 200 generally comprises a feedback control loop (FIG. 12) which periodically monitors pad flatness and moves controlled device 160 radially across pad 126 in the direction of arrow 161 (FIG. 11) to maintain a target flatness profile. As mentioned above, controlled device 160 may comprise ex-situ conditioning device 140, in-situ conditioning elements 142 or wafer carrier elements 124.

Flowchart 300 in FIG. 12 illustrates the method steps followed by flatness system 200 to monitor and control pad flatness. In step 301, prior to mounting pad 126 on wheel 128, the system is initialized by measuring the initial distances of lasers 204 and 206 from wheel 128. Hence, laser 204 transmits the distance IDWHEEL (distance from laser 204 to inner diameter of wheel 128; designated 148 in FIG. 10) to flatness controller 208, and laser 206 transmits the distance ODWHEEL (distance from laser 206 to outer diameter of wheel 128; designated 150 in FIG. 10) to controller 208. IDWHEEL and ODWHEEL are stored in memory 212 for future reference. Alternatively, system 200 may be initialized by setting lasers 204 and 206 to a "zero" value while reading their respective laser-to-wheel distances. That is, instead of storing initial laser-to-wheel distances in memory 212, the distance is set to a zero value so that pad thickness can be measured from that zero reference point.

In step 302, controller 208 enters a wait mode until pad 126 is mounted on wheel 128. Once pad 126 is mounted on wheel 128, in step 303, the initial distances of lasers 204 and 206 from pad 126 are measured. Hence, laser 204 transmits the distance IDPAD (distance from laser 204 to inner diameter of pad 126; designated 152 in FIG. 10) to flatness controller 208, and laser 206 transmits the distance ODPAD (distance from laser 206 to outer diameter of pad 126; designated 154 in FIG. 10) to controller 208. IDPAD and ODPAD are stored in memory 212 for future reference.

In step 304, processor 210 calculates the pad thickness at its inner diameter by subtracting the inner diameter laser-to-pad distance from the inner diameter laser-to-wheel distance. Hence, IDTHICKNESS=IDWHEEL−IDPAD. Similarly, the pad thickness at its outer diameter is calculated as ODTHICKNESS=ODWHEEL−ODPAD. IDTHICKNESS and ODTHICKNESS are designated as, respectively 144 and 146 in FIG. 10. Actual pad flatness, then, is the difference between the outer diameter thickness and inner diameter thickness, or FLATNESS=ODTHICKNESS−IDTHICKNESS.

In step 305, processor 210 compares the calculated actual FLATNESS of pad 126 with a desired or target flatness (TARGET). The target flatness may be manually entered, hard-coded, downloaded or automatically calculated and entered into flatness system 200. As discussed above, in many wafer polishing applications, optimal flatness is about 0.002" (concave), but may vary for different applications. If the actual flatness is greater than the target flatness (FLATNESS>TARGET), then pad 126 has an overly concave profile; similarly, if the actual flatness is less than the target flatness (FLATNESS<TARGET), the pad 126 has an overly convex profile.

If processor 210 determined that pad 126 is overly concave, or that FLATNESS>TARGET, then controller 208 transmits a signal to CMP controller 209 instructing it to move controlled device 160 radially outward for that pad processing cycle (step 306). Device 160 will impose greater wear on the outer radial portions of pad 126 and reduce its concave profile. Conversely, if processor 210 determined that pad 126 was overly convex, or that FLATNESS<TARGET, then controller 208 transmits a signal to CMP controller 209 instructing it to move controlled device 160 radially inwardly for that pad processing cycle (step 307). Device 160 will impose greater wear on the radially inner portions of pad 126 and reduce its convex profile. If FLATNESS=TARGET, controlled device 160 is maintained in its current position.

Conditioning device 160 is preferably moved radially outwardly or inwardly, if movement is required, a distance in the range of 0.2" per cycle. Conditioning time is dependent on the amount of pad wear required and may vary greatly from application to application, but is generally in the range of about 30 to about 300 seconds.

Flatness system 200 may be programmed to periodically obtain flatness readings at any desired time interval. Flatness readings may be taken essentially continuously or, alternatively, only at limited time intervals. Once a flatness reading has been obtained, compared to the target flatness, and conditioning device 160 has been moved (if necessary), the system goes into a wait mode (step 308) until the interval for obtaining another flatness reading arrives. The above process then repeats starting with step 303. If appropriate for a particular application, steps 301–304 for determining pad could be executed concurrently with steps 305–307 for controlling pad flatness.

It should be appreciated that the foregoing description is of preferred exemplary embodiments of the invention and that the invention is not limited to the specific forms shown or described herein. Flatness controller 208, for example, could be eliminated and its functions incorporated into and performed by CMP controller 209. Other modifications may be made in the design, arrangement, and type of elements and steps disclosed herein without departing from the scope of the invention as expressed by the following claims.

I claim:

1. A method for monitoring and controlling actual flatness of a polishing pad of a workpiece polishing machine, said machine having wearing means for wearing an upper surface of said pad, said method comprising the steps of:

mounting said pad on a rotatable wheel of said machine;

measuring a first thickness at an inner diameter of said pad and a second thickness at an outer diameter of said pad;

calculating said actual flatness of said pad based upon at least said first thickness and said second thickness;

comparing said actual flatness to a target flatness; and moving said wearing means to conform said actual flatness to said target flatness if said actual flatness differs from said target flatness.

2. A method as claimed in claim 1, wherein said actual flatness is measured by a laser element mounted above said pad.

3. A method as claimed in claim 2, wherein said laser element includes a first laser which measures its distance ODPAD from said outer diameter portion of said pad and a second laser which measures its distance IDPAD from said inner diameter portion of said pad.

4. A method as claimed in claim 3, wherein prior to mounting said pad on said wheel, said first laser measures its distance ODWHEEL from an outer diameter portion of said wheel, and said second laser measures its distance IDWHEEL from an inner diameter portion of said wheel.

5. A method as claimed in claim 4, wherein said step of measuring said flatness includes calculating an outer diameter pad thickness ODTHICKNESS as ODWHEEL−ODPAD, calculating an inner diameter pad thickness IDTHICKNESS as IDWHEEL−IDPAD, and calculating actual flatness as ODTHICKNESS−IDTHICKNESS.

6. A method as claimed in claim 1, wherein if said actual flatness is greater than said target flatness, said wearing means is moved radially outwardly relative to said pad to increase wear on a radially outer portion of said pad.

7. A method as claimed in claim 1, wherein if said actual flatness is less than said target flatness, said wearing means is moved radially inwardly relative to said pad to increase wear on a radially inner portion of said pad.

8. An apparatus for monitoring and controlling actual flatness of a polishing pad mounted on a workpiece polishing machine, said pad having an inner diameter and an outer diameter, said apparatus comprising:

measuring means for obtaining pad thickness data at said inner diameter and at said outer diameter;

wearing means for wearing an upper surface of said pad; and control means for calculating said actual flatness based on said pad thickness data and, if said actual flatness differs from a target flatness, effecting movement of said wearing means to change said actual flatness.

9. An apparatus as claimed in claim 8, wherein said measuring means comprises a laser element mounted above said polishing pad.

10. An apparatus as claimed in claim 9, wherein said laser element comprises a first laser which measures a first thickness of said outer diameter portion of said pad and a second laser which measures a second thickness of said inner diameter portion of said pad, and said actual flatness is calculated as the difference between said first thickness and said second thickness.

11. An apparatus as claimed in claim 9, wherein said wearing means comprises a pad conditioning device mounted on said machine.

12. An apparatus as claimed in claim 11, wherein said conditioning device is selected from a group consisting of an ex situ conditioning ring, a wafer carrier, and an in situ conditioning ring coupled around a wafer carrier.

13. An apparatus as claimed in claim 11, wherein said control means comprises a computer controller having input means for receiving said thickness data from said laser element, a memory for storing said data, a processor for processing said data and output means for outputting control signals to effect movement of said wearing means.

14. An apparatus as claimed in claim 13, wherein said control means effects a radially outward movement of said conditioning device relative to said pad when said actual flatness is greater than said target flatness, and effects a radially inward movement of said conditioning device relative to said pad when said actual flatness is less than said target flatness.

15. An apparatus for monitoring actual flatness of a polishing pad mounted on a workpiece polishing machine, said apparatus comprising a laser element mounted proximate said pad for measuring said actual flatness, wherein said laser element comprises a first laser for measuring a first thickness of said pad at a first location and a second laser for measuring a second thickness of said pad at a second location, said flatness being the difference between said first thickness and said second thickness.

16. An apparatus as claimed in claim 15, wherein said first location is an outer diameter portion of said pad and said second location is an inner diameter portion of said pad.

17. An apparatus as claimed in claim 16, wherein said laser element is mounted on said machine above said pad.

18. An apparatus as claimed in claim 17, wherein said laser element is mounted on an overhead workpiece carrier portion of said machine.

19. An apparatus as claimed in claim 17, wherein said first laser is aligned above said pad inner diameter portion and said second laser is aligned above said pad outer diameter portion.

20. An apparatus as claimed in claim 17, wherein said pad is mounted on a top surface of a rotatable wheel, and said first laser and said second laser are equidistantly spaced from said top surface of said wheel.

21. A method for monitoring and controlling actual flatness of a polishing pad of a workpiece polishing machine, said method comprising the steps of:

measuring a first thickness of said pad at a first location and a second thickness of said pad at a second location;

calculating said actual flatness of said pad based upon at least said first thickness and said second thickness;

comparing said actual flatness to a target flatness; and conforming said actual flatness to a target flatness if said actual flatness differs from said target flatness.

22. A method as claimed in claim 21, wherein said actual flatness is measured by a laser element mounted above said pad.

23. A method as claimed in claim 22, wherein said laser element includes a first laser which measures a distance ODPAD from an outer diameter portion of said pad corresponding to said first location, and a second laser which measures a distance IDPAD from an inner diameter portion of said pad corresponding to said second location.

24. A method as claimed in claim 23 further comprising the steps of:

providing a rotatable wheel of said machine;

measuring with said first laser a distance ODWHEEL from an outer diameter portion of said wheel;

measuring with said second laser a distance IDWHEEL from an inner diameter portion of said wheel; and mounting said pad on said wheel.

25. A method as claimed in claim 24, wherein said step of measuring said flatness includes calculating an outer diameter pad thickness ODTHICKNESS as ODWHEEL–ODPAD, calculating an inner diameter pad thickness IDTHICKNESS as IDWHEEL–IDPAD, and calculating actual flatness as ODTHICKNESS–IDTHICKNESS.

* * * * *